United States Patent [19]

Gaddes

[11] 4,293,299

[45] Oct. 6, 1981

[54] LOAD SUPPORT DEVICE FOR HEAT FURNACES

[76] Inventor: Robert N. Gaddes, 3222 Stuart La., Dearborn, Mich. 48120

[21] Appl. No.: 137,117

[22] Filed: Apr. 4, 1980

[51] Int. Cl.[3] ..... F27D 3/02

[52] U.S. Cl. ..... 432/234; 432/253; 432/235

[58] Field of Search ..... 432/233–236, 432/238, 243, 246, 253; 165/184

[56] References Cited

U.S. PATENT DOCUMENTS

| | | | |
|---|---|---|---|
| 3,220,712 | 11/1965 | Lott | 432/234 |
| 3,367,641 | 2/1968 | Molz | 432/234 |
| 3,588,059 | 6/1971 | Weineck | 432/234 |
| 3,746,501 | 7/1973 | Sanderson | 432/234 |
| 4,035,141 | 7/1977 | Knaak | 432/234 |
| 4,102,637 | 7/1978 | Kreider et al. | 432/253 |

*Primary Examiner*—Henry C. Yuen
*Attorney, Agent, or Firm*—Adolph G. Martin

[57] ABSTRACT

A load support device for supporting metal slabs as they are moved through a heat furnace having therein a plurality of pipe beams through which a coolant is continuously circulated. The load support device consists of a saddle member mountable on the pipe beams, and having therethrough a longitudinally disposed central opening. A replaceable core, supported in the central opening and removably attached to the saddle member, has on the upper end thereof a head for supportively engaging the metal slabs.

A projection on the lower end of the replaceable core extends below the saddle member so that it will be surrounded by coolant thereby greatly increasing the rate of heat transfer from the replaceable core, which substantially reduces the operating temperature of the head. Deformation, cracking, spalling and burn-out of the head is thus significantly retarded so that those cores with badly worn heads can be replaced when the furnace is shut down for routing inspection and general maintenance.

2 Claims, 9 Drawing Figures

LOAD SUPPORT DEVICE FOR HEAT FURNACES

BACKGROUND OF THE INVENTION

This invention relates generally to furnaces for reheating metal slabs, but more particularly to load support devices for use in such furnaces. Most reheating furnaces currently in use, have both stationary and moveable pipe beams on which unitary load support devices are removably mounted. When the bearing surface on such load support devices becomes badly deteriorated, the furnace must be shut down so that the worn units can be replaced.

Because of the high operating temperatures of such load support devices, they have a relatively short life expectancy, so that emergency repairs, attributable to load support failure, must be made frequently. Fully cognizant of this shortcomming in the conventional unitary load supports presently in use, the applicant has developed a load support device the operating temperature of which is greatly reduced.

This reduction in operating temperature is accompanied by a corresponding decrease in the rate at which the load bearing surface on such support device deteriorates, so that emergency furnace shut-downs, due to load support failure, are virtually eliminated. Consequently, any required repairs to the load support units can be conviently made when the furnace is taken out of service for regularly scheduled routine inspections and general maintenance.

In addition to substantially reducing the frequency of such required repairs to the load support units, the applicant's invention also greatly simplifies such repairs by providing a load bearing surface on a replaceable core which can be removed without detaching the entire unit from the pipe beam on which it is mounted. From the foregoing discussion of the advantages inherent in the applicant's load support device, it is apparent that it can significantly reduce the cost of operating and maintaining re-heating furnaces.

SUMMARY OF THE INVENTION

This invention consists of a saddle member 22 having therethrough a central opening in which is provided an upwardly disposed annular seat 36. A replaceable core 24, in the central opening of the saddle member 22, has thereon a lateral shoulder 46 supported on the annular seat 36. A load support head 48, on the upper end of the replaceable core 24, is detachably and sealably joined to the saddle member 22 by a weld 40. A projection 52, on the lower end of the replaceable core 24, extends below the saddle member 22, so that it will be surrounded by coolant when the unit is mounted on the pipe beam 14 of a heat furnace 10.

CONSTRUCTION

Figure 1:
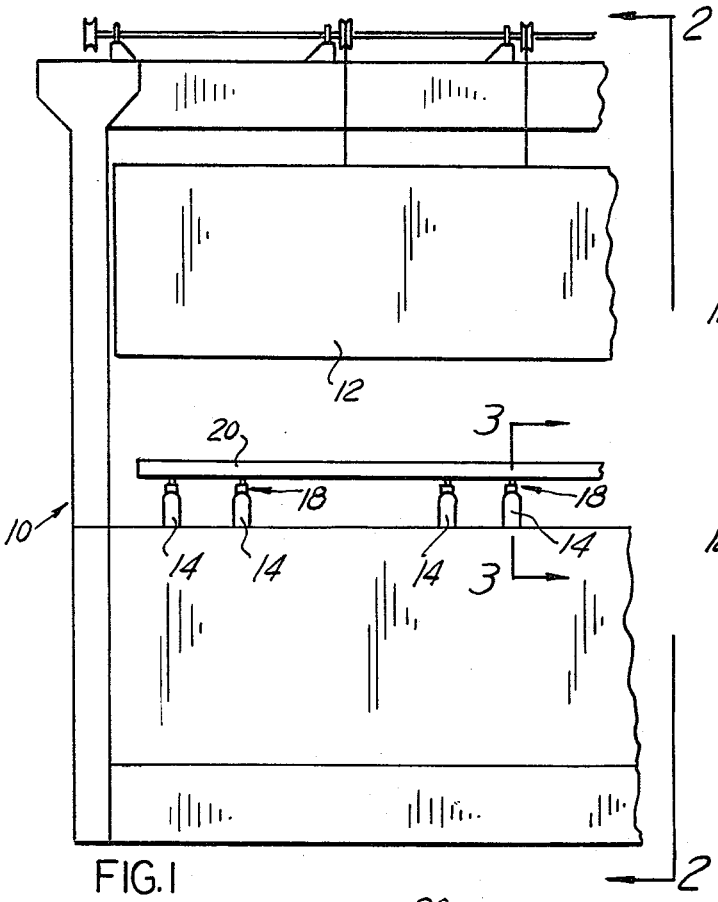
FIG. 1 is a fragmentary elevation view of the discharge end on a conventional heat furnace, showing the moveable and stationary pipe beams 14, with the applicant's load support device 18 thereto attached.
Figure 2:
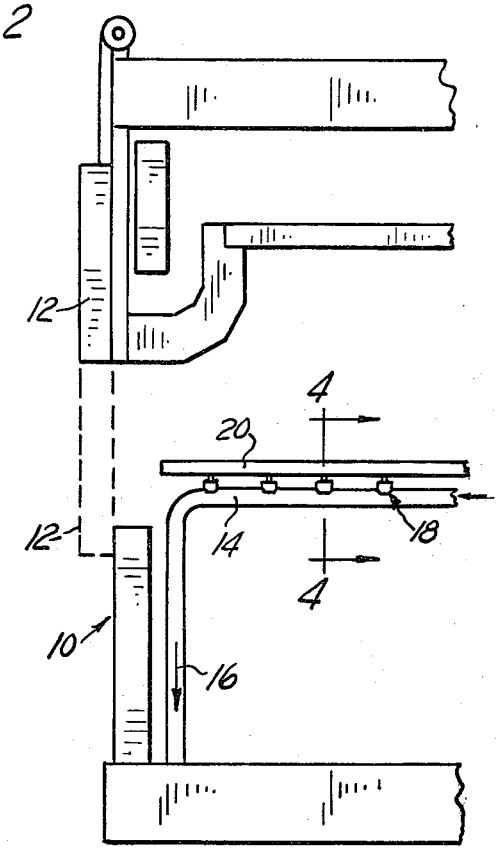
FIG. 2 is a fragmentary side elevation view, taken substantially on plane 2—2 in FIG. 1, showing the lateral spacing of the applicant's load support devices 18 on a pipe beam in the heat furnace 10.
Figure 3:
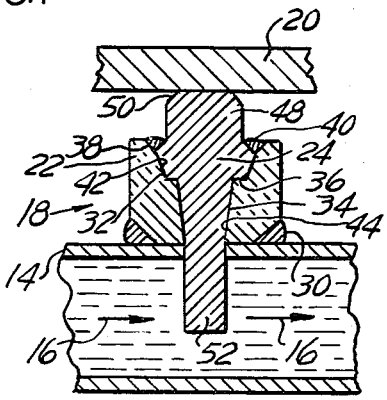
FIG. 3 is an enlarged section view, taken substantially on plane 3—3 in FIG. 1, showing structural details of the applicant's load support device 18.
Figure 7:
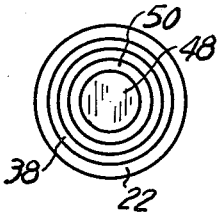
FIG. 7 is an enlarged top plan view, taken substantially on plane 7—7 in FIG. 6, showing the characteristic shape of the saddle member 22, and the head 48 on the replaceable core 24.

For a more detailed description of the applicant's invention, reference is made to FIGS. 1 and 2 of the drawings in which numeral 10 designates a conventional heat furnace with a closure door 12 and having therein a plurality of pipe beams 14 through which a coolant is continuously circulated in the direction indicated by the arrows 16, shown in FIGS. 2 and 3. A plurality of the applicant's load support devices 18 are mounted on the pipe beams 14 of the furnace 10, for supporting a load, such as a metal slab 20, shown in FIGS. 1 through 4 of the drawings.

Figure 4:
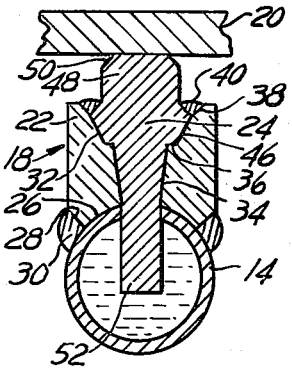
FIG. 4 is an enlarged section view, taken substantially on plane 4—4 in FIG. 2, showing further structural details of the applicant's load support device 18.
Figure 5:
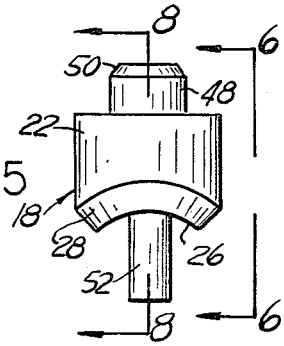
FIG. 5 is an enlarged front elevation view of the applicant's load support device 18, detached from the pipe beam 14, and showing the characteristic shape of the saddle member 22.
Figure 6:
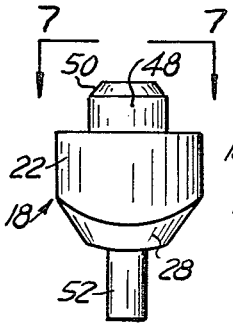
FIG. 6 is an enlarged side elevation view of the applicant's load support device 18, taken substantially on plane 6—6 in FIG. 5, showing further structural details of the saddle member 22.
Figure 8:
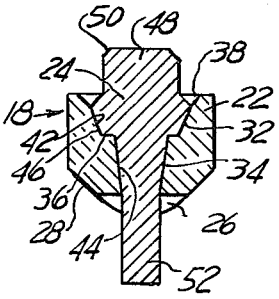
FIG. 8 is an enlarged section view, taken substantially on plane 8—8 in FIG. 5, showing further structural details of the saddle member 22.

The applicant's load support device 18 has a saddle member 22, and a replaceable core 24, as shown in FIGS. 3 through 9 of the drawings. The saddle member 22 has a central opening therethrough, and a downwardly disposed concavity 26 on the lower end. A bevel 28 is provided around the periphery of the concavity 26 to receive a weld 30 for attaching the saddle member 22 on a pipe beam 14, as shown in FIGS. 3 and 4 of the drawings.

A pair of upwardly disposed flared sections 32 and 34, in the central opening of the saddle member 22, are separated by an annular seat 36. A bevel 38 is provided around the upper end of the central opening to receive a weld 40 for sealably and detachably joining the replaceable core 24 to the saddle member 22, as shown in FIGS. 3 and 4 of the drawings. Two spaced tapered segments 42 and 44, on the replaceable core 24, are in seating engagement with the upwardly disposed flared sections 32 and 34 respectively in the central opening through the saddle member 22.

A lateral shoulder 46, between the two spaced tapered segments 42 and 44, is supported on the annular seat 36 in the central opening through the saddle member 22. A head 48, on the upper end of the replaceable core 24, has therearound an inwardly disposed bevel 50. An axial projection 52, on the lower end of the replaceable core 24, extends below the concavity 26 in the saddle member 22. This completes a detailed description relating to the preferred embodiment of the applicant's invention, as disclosed in FIGS. 1 through 8 of the drawings.

Figure 9:
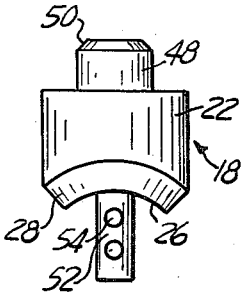
FIG. 9 is an elevation view, similar to FIG. 5, showing a slight modification of the applicant's invention.

FIG. 9 discloses a slight modification of the applicant's invention in which the axial projection 52, on the lower end of the replaceable core 24, has therethrough a pair of spaced openings 54, the longitudinal axis of which is to be disposed parallel to that of the concavity 26 when the replaceable core 52 is sealably and detachably joined to the saddle member 22 by the weld 30, shown in FIGS. 3 and 4 of the drawings. In all other respects, the construction shown in FIG. 9 is identical to that of the preferred embodiment.

In practice, it has proven desireable to make the saddle member 22 and replaceable core 24 of materials having extremely high corrosion and heat resistant properties, such as a superior grade of stainless steel. In the process of installing the applicant's load support device 18 in a heat furnace 10, the replaceable core 24 may be joined to the saddle member 22, either prior to or at the time it is mounted on a pipe beam 14 in the furnace 10, whichever is deemed to be more convenient and expedient.

The preceding discussion completes a description of the structural details of the two embodiments of the applicant's invention herein disclosed. However, to facilitate a more thorough understanding and comprehension of the subject matter herein presented, a discussion of the manner in which the device is used and functions to fulfill its intended purpose and achieve its objectives, is immediately hereinafter set forth.

In use, a saddle member 22, containing a replaceable core 24 attached thereto in the manner previously described, is mounted on a pipe beam 20 in the heat furnace 10, by the placement of a weld 30 in the bevel 28, as shown in FIGS. 1 through 4 of the drawings. After the furnace 10 has been in operation for approximately 12 months, a shut down is normally scheduled for routine inspection and regular maintenance.

In the course of such routine annual inspections, if any of the heads 48 on the replaceable cores 24 are worn to within an eighth of an inch of the weld 40 therearound, such weld is dissolved, and the worn core 24 removed. A new core is then inserted into the saddle member 22 and joined thereto by a new weld 40. In practice, the remaining cores 24 on the other load support devices 18, transversely aligned with the new core 24, must be replaced at the same time. This practice makes certain that the upper surface on the heads 48 of all the transversely aligned load support devices 18 fall in the same lateral plane, so as to insure equal load distribution.

Based upon the foregoing discussion, the applicant is of the opinion that his invention has fulfilled a long-felt need in the field of load support devices for heat furnaces, and that he has accordingly made a valuable contribution to the related art. However, while the invention has been described with reference to the structural details of only two embodiments, it will be appreciated by those familiar with the art, that the principles involved are susceptible of numerous other practical adaptations.

I therefore claim as new, and desire to secure by Letters Patent:

1. A load support device for heat furnaces having a plurality of pipe beams through which coolant is circulated, such support device comprising a saddle member mountable on the pipe beams and having therethrough a central opening, a replaceable core in the central opening of the saddle member, an upwardly disposed annular seat in the central opening through the saddle member, a lateral shoulder on the replaceable core supported on the upwardly disposed annular seat, an inwardly and downwardly disposed bevel around the lower end of the saddle member to receive a weld for mounting such member on a pipe beam in said heat furnace, an upwardly disposed bevel around the upper end of the central opening to receive a weld for detachably and sealably joining the replaceable core to the saddle member, an upwardly disposed flared section in the central opening through the saddle member below the annular seat therein, a tapered segment on the replaceable core in seating engagement with such flared section, an upwardly disposed flared section in the central opening through the saddle member above the annular seat therein, a tapered segment on the replaceable core in seating engagement with such flared section, a head on the upper end of the replaceable core for directly supporting load, and a projection on the lower end of the replaceable core extending below the saddle member so as to extend into a pipe beam in said heat furnace when the saddle member is thereon mounted.

2. The load support device of claim 1 in which the projection on the lower end of the replaceable core has therethrough at least one opening to be disposed parallel to the longitudinal axis of the pipe beam on which said device is to be mounted to expedite the transfer of heat from the replaceable core to the coolant circulating in said pipe beam.

* * * * *